US008985496B2

(12) United States Patent
Dillinger et al.

(10) Patent No.: US 8,985,496 B2
(45) Date of Patent: Mar. 24, 2015

(54) EXPANDABLE DRUM ASSEMBLY FOR DEPLOYING COILED PIPE

(71) Applicant: FlexSteel Pipeline Technologies, Inc., Houston, TX (US)

(72) Inventors: Brian Dillinger, Missouri City, TX (US); Jagtar Thethy, Houston, TX (US)

(73) Assignee: FlexSteel Pipeline Technologies, Inc., Houston, TX (US)

( * ) Notice: Subject to any disclaimer, the term of this patent is extended or adjusted under 35 U.S.C. 154(b) by 185 days.

(21) Appl. No.: 13/737,816

(22) Filed: Jan. 9, 2013

(65) Prior Publication Data

US 2014/0191076 A1 Jul. 10, 2014

Related U.S. Application Data

(60) Provisional application No. 61/587,588, filed on Jan. 17, 2012.

(51) Int. Cl.
*B65H 75/24* (2006.01)

(52) U.S. Cl.
CPC ..... *B65H 75/242* (2013.01); *B65H 2701/33* (2013.01)
USPC ..... 242/577; 242/577.1; 242/577.2; 242/577.3

(58) Field of Classification Search
USPC ..... 242/577, 577.1–577.4, 576, 576.1, 242/407.1, 607.1
See application file for complete search history.

(56) References Cited

U.S. PATENT DOCUMENTS

| | | | | |
|---|---|---|---|---|
| 1,490,429 | A | 4/1924 | Parks | |
| 2,370,868 | A * | 3/1945 | Luebke | 242/407.1 |
| 2,598,398 | A * | 5/1952 | Littell et al. | 242/573.7 |
| 5,025,999 | A * | 6/1991 | Littrell | 242/577 |
| 7,810,533 | B2 | 10/2010 | Wichern | |
| 2009/0152390 | A1 * | 6/2009 | Underbrink et al. | 242/432.6 |

OTHER PUBLICATIONS

PCT International Search Report of PCT/US13/21128; dated Mar. 22, 2013.
PCT Written Opinion of the International Searching Authority of PCT/US13/21128; dated Mar. 22, 2013.

* cited by examiner

*Primary Examiner* — Sang Kim
(74) *Attorney, Agent, or Firm* — Osha Liang L.L.P.

(57) ABSTRACT

A drum assembly having a post, and first and second spoke frames. Each of the first and second spoke frames includes expandable spokes and immovable spokes, extending away from the post. Each expandable spoke includes a distal end movable between a retracted position and an extended position. A plurality of first drum segments each are mounted to the distal end of one of the expandable spokes of the first spoke frame and to the distal end of one of the expandable spokes of the second spoke frame. A plurality of second drum segments each mounted to an end of one of the immovable spokes of the first spoke frame and to an end of one of the immovable spokes of the second spoke frame. Mechanical actuators, extending between the post and either the expandable spokes or the first drum segments, move the expandable spokes between the retracted and extended positions.

20 Claims, 5 Drawing Sheets

EXPANDABLE DRUM ASSEMBLY FOR DEPLOYING COILED PIPE

RELATED APPLICATIONS

This application claims the benefit of U.S. Provisional Application No. 61/587,588, filed Jan. 17, 2012, and which is incorporated herein by reference.

FIELD OF THE INVENTION

The present invention relates to flexible pipe, and more particularly to reels used to store, ship and deploy flexible pipe.

BACKGROUND OF THE INVENTION

Currently, flexible pipe that can accommodate fluids at relatively high pressures (e.g. for use in the oil and gas industry) is typically coiled on reels (after manufacture), stored on reels, shipped on reels, and many times deployed directly from reels. A conventional reel 2 is illustrated in FIGS. 1A-1C, which includes a cylindrical drum 4 (about which the flexible pipe 6 is wound), and flanges 8 extending from the edges of the drum to retain the pipe wound around the drum 4. A conventional reel loaded with flexible pipe is illustrated in FIG. 1D.

Typically, pipe suppliers must have a large fleet of reels to handle pipe production and shipping processes, which can be costly. In addition, shipping pipe on reels incurs larger shipping costs, as there are weight limits on shipments on trucks. With a double drop trailer (which is normally used), a truck can pull a load that is roughly 38,000 lb. Two reels of flexible pipe for the oil/gas industry are all that can fit onto a double drop trailer. The reels themselves can weigh approximately 3200 lb each. Thus, only about 31,600 lb of pipe can be shipped on a single truck.

Once reels of pipe are shipped out to customers, the customers typically have to rent the reels in their possession (i.e. until the pipe thereon is deployed). Once the customer has deployed the pipe, the empty reels (which are expensive) must be shipped back to the pipe supplier, incurring additional shipping costs. Additional costs are further incurred to maintain the reels.

There is a need for a more economical solution in deploying coils of pipe without the expense and other drawbacks of conventional reels.

BRIEF SUMMARY OF THE INVENTION

The aforementioned problems and needs are addressed by a drum assembly that includes a post, first and second spoke frames mounted to the post, a plurality of drum segments, and a plurality of mechanical actuators. Each of the first and second spoke frames includes a plurality of expandable spokes, wherein each of the expandable spokes extends away from the post and has a distal end movable between a retracted position and an extended position. The plurality of drum segments are each mounted to the distal end of one of the expandable spokes of the first spoke frame and to the distal end of one of the expandable spokes of the second spoke frame, wherein the drum segments extend parallel to the post. The plurality of mechanical actuators each extend between the post and one of the expandable spokes or one of the drum segments, for moving the expandable spokes between the retracted and extended positions.

In another aspect of the present invention, a drum assembly includes a post, first and second spoke frames mounted to the post, a plurality of first drum segments, a plurality of second drum segments, and a plurality of mechanical actuators. Each of the first and second spoke frames includes a plurality of expandable spokes and a plurality of immovable spokes which extend away from the post, wherein each of the expandable spokes includes a distal end movable between a retracted position and an extended position. The plurality of first drum segments are each mounted to the distal end of one of the expandable spokes of the first spoke frame and to the distal end of one of the expandable spokes of the second spoke frame, wherein each of the plurality of first drum segments extends parallel to the post. The plurality of second drum segments are each mounted to an end of one of the immovable spokes of the first spoke frame and to an end of one of the immovable spokes of the second spoke frame, wherein each of the plurality of second drum segments extends parallel to the post. The plurality of mechanical actuators each extend between the post and one of the expandable spokes or one of the plurality of first drum segments, for moving the expandable spokes between the retracted and extended positions.

In yet another aspect of the present invention, a drum assembly includes a post, first and second spoke frames mounted to the post, a pair of first drum segments, a pair of second drum segments, and a plurality of mechanical actuators. Each of the first and second spoke frames includes a pair of expandable spokes and a pair of immovable spokes which extend away from the post, wherein each of the expandable spokes includes a distal end movable between a retracted position and an extended position. The pair of first drum segments are each mounted to the distal end of one of the expandable spokes of the first spoke frame and to the distal end of one of the expandable spokes of the second spoke frame, wherein each of the first drum segments extends parallel to the post. The pair of second drum segments are each mounted to an end of one of the immovable spokes of the first spoke frame and to an end of one of the immovable spokes of the second spoke frame, wherein each of the second drum segments extends parallel to the post. The plurality of mechanical actuators each extend between the post and one of the expandable spokes or one of the first drum segments, for moving the expandable spokes between the retracted and extended positions.

Other objects and features of the present invention will become apparent by a review of the specification, claims and appended figures.

DETAILED DESCRIPTION OF THE INVENTION

The present invention is an expandable coil deployment drum assembly 10 that enables coils of pipe that would normally require reels for deployment to be deployed in a very similar manner, but without reels. With the coil deployment drum assembly 10, the necessity of reels is essentially eliminated as reels will not be required for pipe deployment (or for shipment of coils due to shipping coils with no reels). A substantial cost savings can be achieved with the elimination of reels.

Figure 1A:
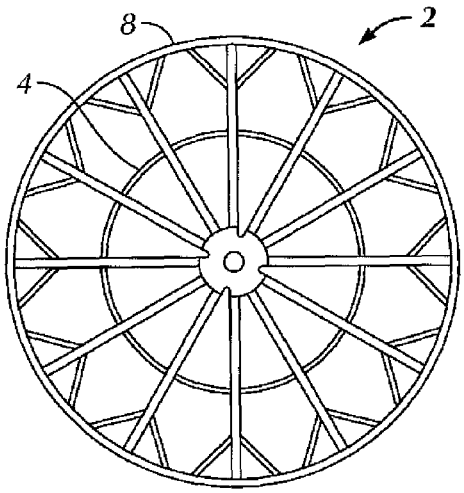
FIG. 1A (Prior Art)
FIG. 1A is a side view of a conventional pipe reel.
Figure 1B:
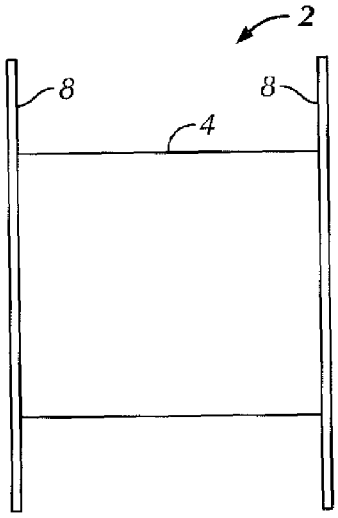
FIG. 1B (Prior Art)
FIG. 1B is an end view of a conventional pipe reel.
Figure 1C:
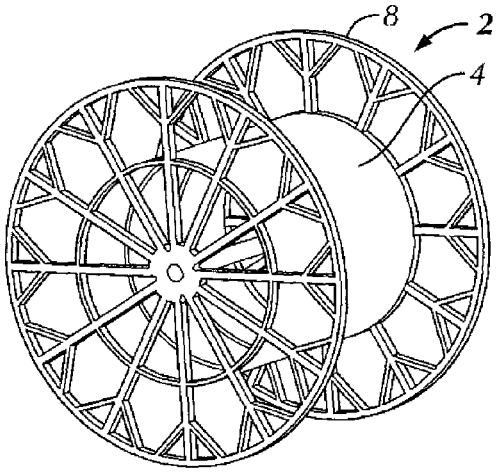
FIG. 1C (Prior Art)
FIG. 1C is a perspective view of a conventional pipe reel.
Figure 1D:
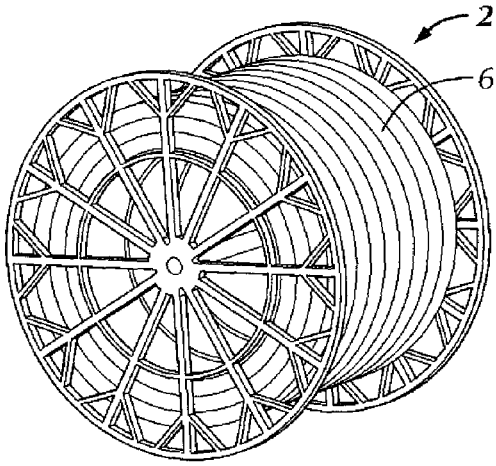
FIG. 1D (Prior Art)
FIG. 1D is a perspective view of a conventional pipe reel, with flexible pipe wound thereon.
Figure 2:
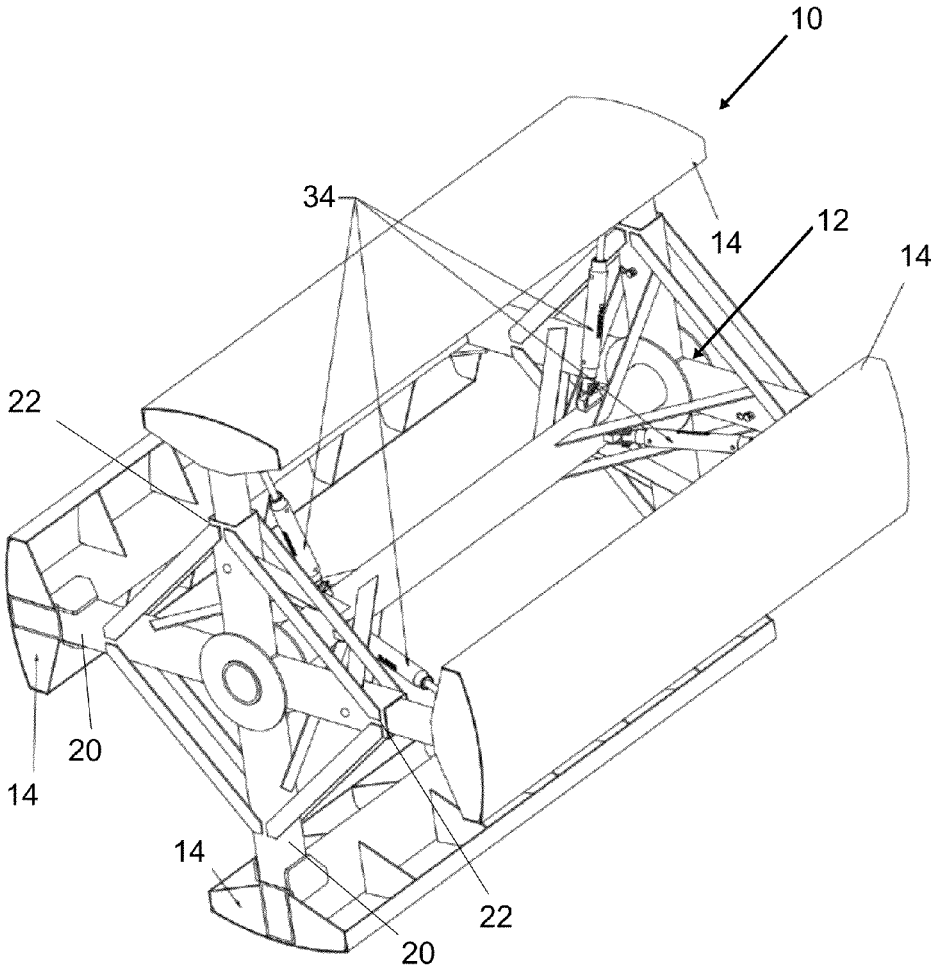
FIG. 2 is a perspective view of the drum assembly of the present invention.
Figure 3:
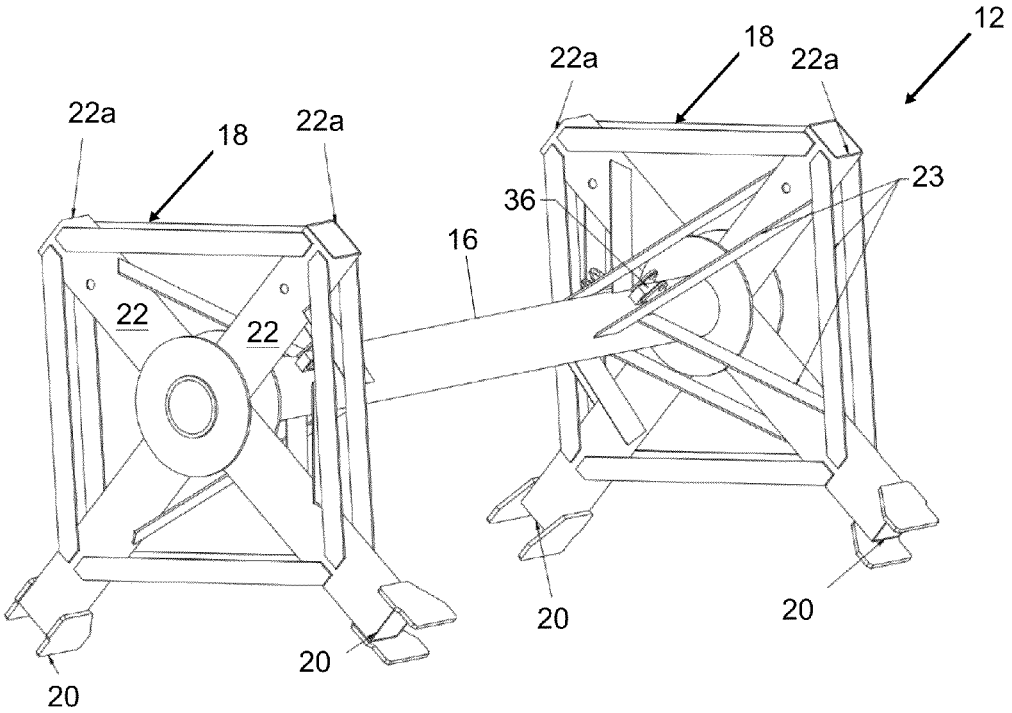
FIG. 3 is a perspective view of a drum frame of the drum assembly.
Figure 4:
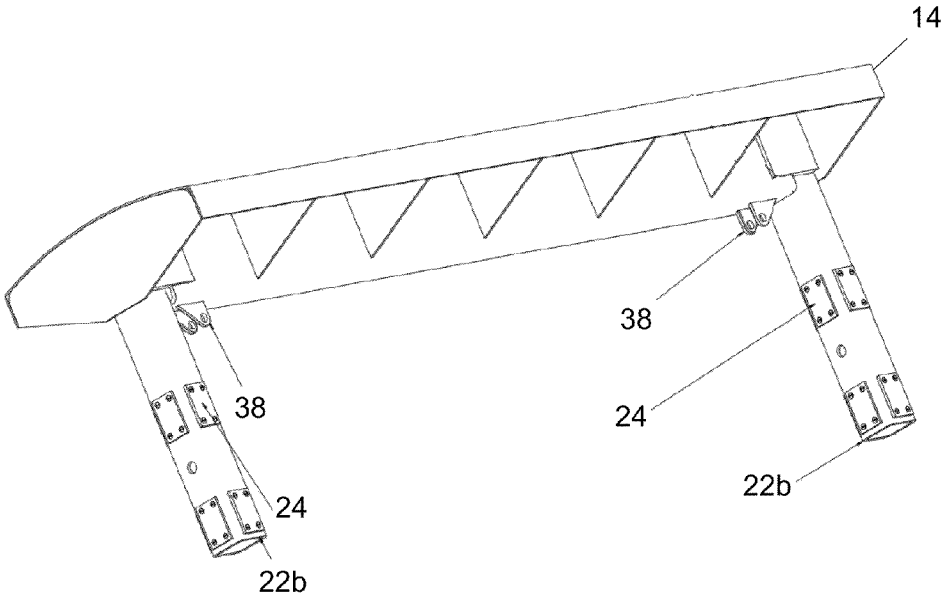
FIG. 4 is a perspective view of a drum segment of the drum assembly.

The coil deployment drum assembly 10 is illustrated in FIG. 2, and includes a drum frame 12 and a plurality of drum segments 14. As better shown in FIG. 3, the drum frame 12 includes a post 16 and a pair of spoke frames 18 each mounted to one end of post 16. Post 16 can be a solid bar, but is preferably a hollow tube with open ends for providing a place to grab and manipulate the drum assembly 10. Each spoke frame 18 includes a pair of rigid (i.e. immovable) spokes 20 and a pair of expandable spokes 22, extending radially away from post 16. Each rigid spoke 20 is a solid bar or hollow tube having a proximal end at the end of post 16 and a distal end away from post 16. Each expandable spoke 22 includes a hollow tube 22*a* having a proximal end at the end of post 16 and a distal end away from post 16, and a rigid member 22*b* (e.g. a solid bar or hollow tube) that telescopically slides in hollow tube 22*a* with the aid of bearing pads 24 (e.g. UHMW polyethylene) mounted to the sides of rigid member 22*b*, as best shown in FIGS. 3 and 4. A plurality of struts 23 are each mounted to and extend between post 16 and one of the spokes 20/22, or between one of the spokes 20/22 to another of the spokes 20/22. Struts 23 provide mechanical stability, rigidity and support.

Figure 5:
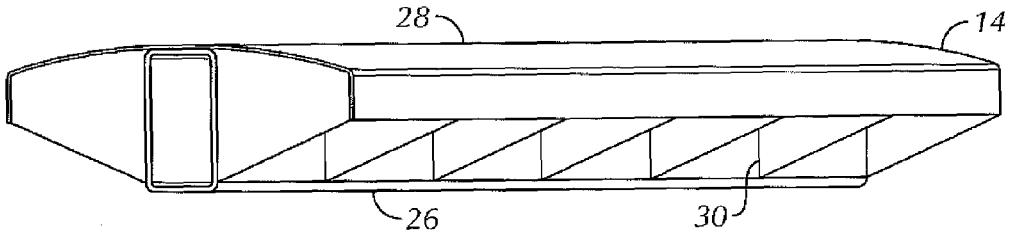
FIG. 5 is a perspective view of a drum segment of the drum assembly.

A plurality of drum segments 14 are each mounted to the ends of corresponding spokes 20/22 of spoke frames 18 (parallel to and spaced apart from post 16), as best shown in FIGS. 2, 4 and 5. Each drum segment 14 includes a rigid member 26 (e.g. solid bar or hollow tube), an curved plate 28 extending over the rigid member 26, and a plurality of gussets 30 supporting the curved plate 28 on the rigid member 26. Preferably, the drum assembly 10 is made of steel or other rigid metal. Spokes/members 20, 22 and 26 preferably have a rectangular cross section, for better rigidity and strength.

Hydraulic cylinders 34 are connected between the post 16 (via connectors 36) and the drum segments 14 of the expandable spokes 22 (via connectors 38). Hydraulic cylinders (also commonly called linear hydraulic motors) are mechanical actuators that are well known in the art, and not further described herein. Hydraulic cylinders 34 are used to move the expandable spokes 22 between a retracted position (see FIG. 6A) and an extended position (see FIG. 6B). In the retracted position, the curved plates 28 define a cylindrical section of a smaller diameter than that when in the extended position, as further explained below.

Figure 6A:
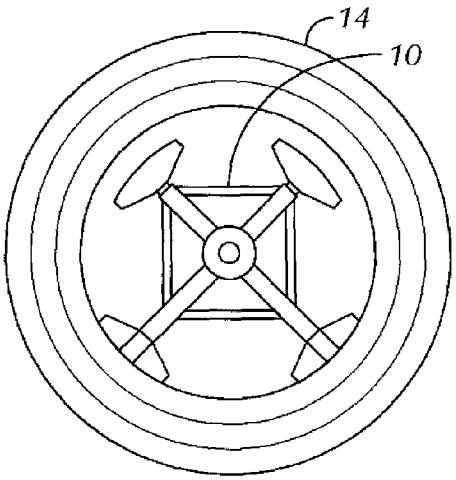
FIG. 6A is a side view of the drum assembly, in its retracted position, inserted in a coil of pipe.
Figure 6B:
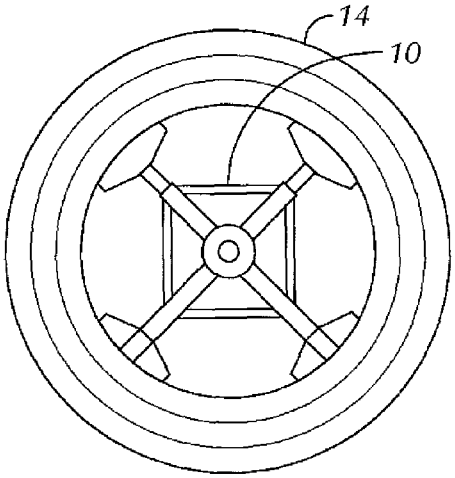
FIG. 6B is a side view of the drum assembly, in its extended position, inserted in a coil of pipe.
Figure 7:
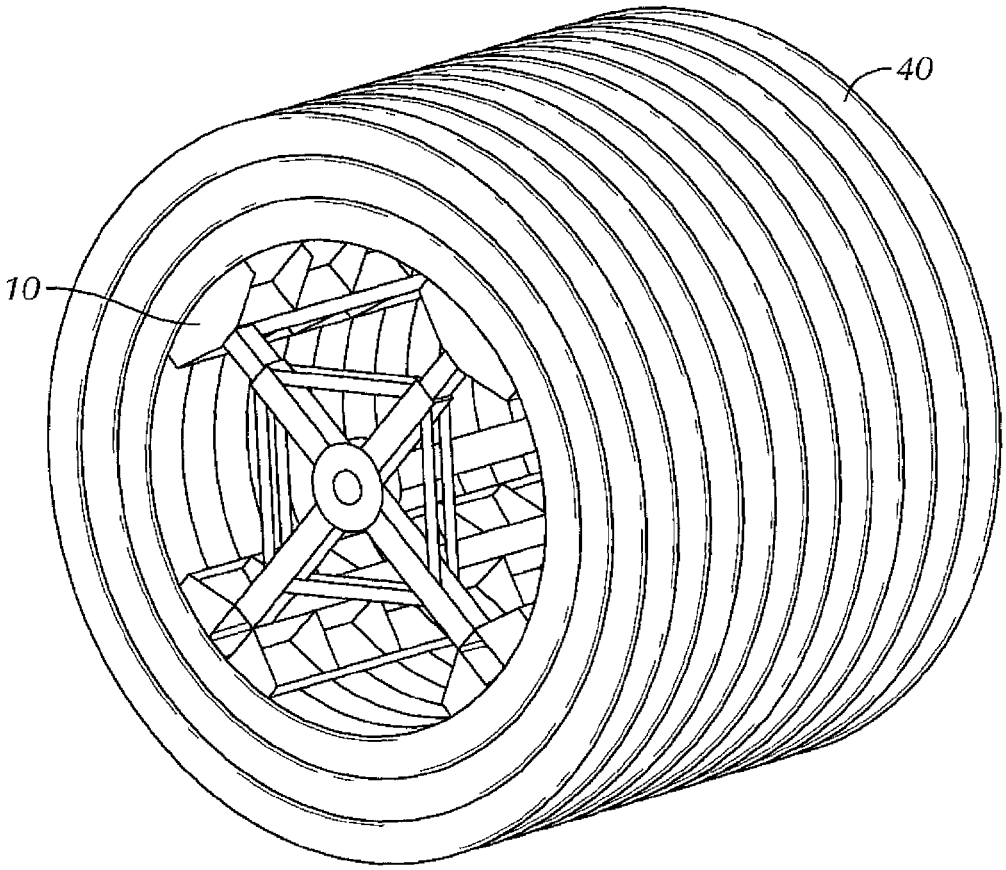
FIG. 7 is a perspective view of the drum assembly, in its extended position, inserted in a coil of pipe.

In a preferred non-limiting exemplary embodiment, the drum assembly 10 is configured to be used to manipulate and/or deploy coils of pipe that are approximately 84 inches in inside diameter by approximately 94 inches wide and weigh 20,000 lb. However, the structure is scalable to work with pipe coils of varying sizes and weights. The telescoping action of the expandable spokes 22 allows the drum assembly 10 to contract to approximately a 77 inch diameter. The contraction provides clearance for the drum assembly 10 to be inserted into coiled pipe 40 that is roughly 84 inches in inside diameter, as illustrated in FIG. 6A. Once the drum assembly 10 is inserted into the coil of pipe 40, the expandable spokes are expanded to contact the inside diameter of the pipe coil 40 with all four drum segments 14 with enough pressure on the inside of the pipe coil 40 such that the pipe coil 40 is secured to the drum assembly 10, as illustrated in FIGS. 6B and 7. Upon successfully inserting and securing the drum assembly 10 into the coil of pipe 40, the drum assembly 10 and pipe coil 40 can be lifted by a deployment trailer to deploy the pipe as it would be deployed if the pipe were on a reel. For example, the post 16 can be used to grab and manipulate the drum assembly 10 and thus the pipe coil 40 secured thereto.

With the use of drum assembly 10, reels will no longer be necessary for deploying pipe. Instead, pipe can be coiled (without reels) and stored and shipped using wooden skids. Wooden skids are far lighter than reels and are disposable (i.e. no need to ship back to the pipe supplier). Using wooden skids to support coils of pipe allows for much more pipe to be shipped on a double drop trailer. Wooden skids weigh approximately 400 lb each. Therefore, 37,200 lb of pipe can be shipped using coils disposed on skids. Eliminating reels allows approximately 5600 lb more pipe to be shipped per truck, which reduces costs. Eliminating reels also eliminates the costs of reel maintenance.

In many applications, the drum assemblies 10 can simply stay in the field with the deployment trailers. Wherever there is a trailer to deploy pipe on a job site, there can be several drum assemblies 10. When the coils of pipe 40 are delivered to the job site, they will be unloaded from the truck. It is at this point that the drum assembly 10 is ideally used. Since the pipe is not wrapped on a reel, there is no convenient way to mount the pipe on the deployment trailer by itself. Thus, the drum assembly 10 is inserted into the pipe coil and expanded, and then the deployment trailer can lift the coil of pipe using the post 16 of the drum frame 12. From there, the pipe can be deployed from the drum assembly 10 in mostly the same manner as it would be deployed using a reel. Once done, the drum assembly 10 can be locally stored in the field for the next delivery of coiled pipe.

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. Materials, processes and numerical examples described above are exemplary only, and should not be deemed to limit the claims. Further, while hydraulic cylinders 34 are shown as the mechanism for moving the expandable spokes between the retracted and extended positions, other mechanical actuators could instead be used (for example, mechanical screw actuators). Hydraulic cylinders 34 could be connected to the rigid members 22*b* instead of the drum segments 14. Lastly, while two rigid and two expandable spokes are shown and described above, fewer or additional rigid and/or expandable spokes can be used (e.g. all spokes could be expandable, or more than four spokes can be used, etc.).

What is claimed is:

1. A drum assembly, comprising:

a post;

expandable spokes, wherein each of the expandable spokes extends away from the post and has a distal end movable between a retracted position and an extended position;

first and second spoke frames mounted to the post, wherein each of the first and second spoke frames includes a plurality of the expandable spokes;

a plurality of drum segments each mounted to the distal end of one of the expandable spokes of the first spoke frame and to the distal end of one of the expandable spokes of the second spoke frame, wherein the drum segments extend parallel to the post; and a plurality of mechanical actuators each extending between the post and one of the expandable spokes or one of the drum segments, for moving the expandable spokes between the retracted and extended positions.

2. The drum assembly of claim 1, wherein the first and second spoke frames each further include a plurality of immovable spokes extending away from the post, the drum assembly further comprising:

a second plurality of drum segments each mounted to an end of one of the immovable spokes of the first spoke frame and to an end of one of the immovable spokes of the second spoke frame, wherein the second plurality of drum segments extend parallel to the post.

3. The drum assembly of claim 1, wherein each of the plurality of drum segments comprises:

a rigid member; and a curved plate mounted to the rigid member.

4. The drum assembly of claim 3, wherein each of the plurality of drum segments further comprises:

a plurality of gussets each connected to the rigid member and the curved plate.

5. The drum assembly of claim 1, further comprising:

a plurality of first struts each extending between the post and one of the expandable spokes; and a plurality of second struts each extending between one of the expandable spokes and another of the expandable spokes.

6. The drum assembly of claim 1, wherein each of the plurality of mechanical actuators is a hydraulic cylinder.

7. The drum assembly of claim 1, wherein each of the expandable spokes comprises:

a hollow tube connected to the post; and a rigid member telescopically slidably disposed in the hollow tube.

8. The drum assembly of claim 7, wherein the hollow tubes and the rigid members have rectangular cross sectional shapes.

9. The drum assembly of claim 7, wherein each of the rigid members includes a plurality of bearing pads attached to an outer surface thereof.

10. A drum assembly, comprising:

a post;

expandable spokes, wherein each of the expandable spokes includes a distal end movable between a retracted position and an extended position;

immovable spokes that extend away from the post;

first and second spoke frames mounted to the post, wherein each of the first and second spoke frames includes a plurality of the expandable spokes and a plurality of the immovable spokes;

a plurality of first drum segments each mounted to the distal end of one of the expandable spokes of the first spoke frame and to the distal end of one of the expandable spokes of the second spoke frame, wherein each of the plurality of first drum segments extends parallel to the post;

a plurality of second drum segments each mounted to an end of one of the immovable spokes of the first spoke frame and to an end of one of the immovable spokes of the second spoke frame, wherein each of the plurality of second drum segments extends parallel to the post; and a plurality of mechanical actuators each extending between the post and one of the expandable spokes or one of the plurality of first drum segments, for moving the expandable spokes between the retracted and extended positions.

11. The drum assembly of claim 10, wherein each of the first and second drum segments comprises:

a rigid member; and a curved plate mounted to the rigid member.

12. The drum assembly of claim 11, wherein each of the first and second drum segments further comprises:

a plurality of gussets each connected to the rigid member and the curved plate.

13. The drum assembly of claim 10, further comprising:

a plurality of first struts each extending between the post and one of the expandable spokes;

a plurality of second struts each extending between the post and one of the immovable spokes;

a plurality of third struts each extending between one of the expandable spokes and another of the expandable spokes;

a plurality of fourth struts each extending between one of the expandable spokes and one of the immovable spokes.

14. The drum assembly of claim 10, wherein each of the plurality of mechanical actuators is a hydraulic cylinder.

15. The drum assembly of claim 10, wherein each of the expandable spokes comprises:

a hollow tube connected to the post; and a rigid member telescopically slidably disposed in the hollow tube.

16. The drum assembly of claim 15, wherein the hollow tubes and the rigid members have rectangular cross sectional shapes.

17. The drum assembly of claim 15, wherein each of the rigid members includes a plurality of bearing pads attached to an outer surface thereof.

18. A drum assembly, comprising:

a post;

expandable spokes, wherein each of the expandable spokes includes a distal end movable between a retracted position and an extended position;

immovable spokes that extend away from the post;

first and second spoke frames mounted to the post, wherein each of the first and second spoke frames includes a pair of the expandable spokes and a pair of the immovable spokes;

a pair of first drum segments each mounted to the distal end of one of the expandable spokes of the first spoke frame and to the distal end of one of the expandable spokes of the second spoke frame, wherein each of the first drum segments extends parallel to the post;

a pair of second drum segments each mounted to an end of one of the immovable spokes of the first spoke frame and to an end of one of the immovable spokes of the second spoke frame, wherein each of the second drum segments extends parallel to the post; and a plurality of mechanical actuators each extending between the post and one of the expandable spokes or one of the first drum segments, for moving the expandable spokes between the retracted and extended positions.

19. The drum assembly of claim 18, wherein each of the expandable spokes comprises:

a hollow tube connected to the post; and a rigid member telescopically slidably disposed in the hollow tube.

20. The drum assembly of claim 19, wherein the hollow tubes and the rigid members have rectangular cross sectional shapes.

* * * * *